US010426995B1

(12) United States Patent
Fiocchi

(10) Patent No.: US 10,426,995 B1
(45) Date of Patent: Oct. 1, 2019

(54) ARM EXERCISE ASSEMBLIES

(71) Applicant: Lee Fiocchi, Houston, TX (US)

(72) Inventor: Lee Fiocchi, Houston, TX (US)

( * ) Notice: Subject to any disclaimer, the term of this patent is extended or adjusted under 35 U.S.C. 154(b) by 0 days.

(21) Appl. No.: 16/355,696

(22) Filed: Mar. 15, 2019

(51) Int. Cl.
*A63B 21/00* (2006.01)
*A63B 23/14* (2006.01)
*A63B 21/005* (2006.01)
*A63B 23/035* (2006.01)

(52) U.S. Cl.
CPC ..... *A63B 21/4049* (2015.10); *A63B 21/005* (2013.01); *A63B 21/4035* (2015.10); *A63B 23/03533* (2013.01); *A63B 23/14* (2013.01)

(58) Field of Classification Search
CPC . A63B 23/14; A63B 21/4025; A63B 21/4017; A63B 21/0004; A63B 21/05; A63B 2023/00; A63B 21/4035; A63B 21/0552; A63B 21/00069; A63B 21/4043; A63B 21/4019; A63B 21/4049; A63B 23/03508; A63B 23/16; A63B 2023/006; A63B 69/0059; A63B 21/402
USPC ..... 482/44–50
See application file for complete search history.

(56) References Cited

U.S. PATENT DOCUMENTS 3,384,370 A * 5/1968 Bailey ..... A63B 21/0724 482/106
4,589,655 A * 5/1986 Ammon ..... A63B 21/0004 482/46
4,629,184 A * 12/1986 Selkee ..... A63B 21/0724 482/106
4,770,409 A * 9/1988 Wallisch ..... A63B 23/03533 482/128
RE33,218 E * 5/1990 Twardosz ..... A63B 21/0724 482/106
5,067,479 A * 11/1991 Saringer ..... A61H 1/0285 601/40
5,271,617 A 12/1993 Gilford
5,364,323 A 11/1994 Liu
5,425,690 A 6/1995 Chang
5,454,769 A 10/1995 Chen
5,582,402 A 12/1996 Gilford
5,702,324 A 12/1997 Wendel
6,146,341 A * 11/2000 Sato ..... A61H 1/0237 482/44
6,921,352 B1 7/2005 Stearns
7,094,182 B1 * 8/2006 Holten ..... A63B 23/14 482/115
7,238,147 B2 * 7/2007 Mills ..... A63B 21/0605 482/106
7,537,547 B1 * 5/2009 Hosick ..... A63B 23/12 482/124
D609,289 S * 2/2010 Chen ..... D21/684
(Continued)

*Primary Examiner* — Andrew S Lo
(74) *Attorney, Agent, or Firm* — Elliott & Polasek, PLLC; Douglas H. Elliott; Nathan Q. Huynh

(57) ABSTRACT

The disclosure herein includes an arm exercise assembly, which arm exercise assembly may include: a frame shaped and sized to receive a human forearm; a piston coupled to the frame; a bracket pivotably coupled to the frame; a wheel coupled to the piston and pivotably coupled to the bracket; two locks extending radially through the wheel toward inner portions of the wheel; and a handle pivotably coupled to the wheel, wherein the handle may be capable of being abutted against one or both of the two locks.

20 Claims, 6 Drawing Sheets

(56) References Cited

U.S. PATENT DOCUMENTS

| | | | | |
|---|---|---|---|---|
| 7,862,486 | B1 * | 1/2011 | Watson | A63B 21/0724 482/106 |
| 8,678,984 | B1 | 3/2014 | Polucci | |
| 8,974,351 | B2 | 3/2015 | Wallisch | |
| 9,511,257 | B2 | 12/2016 | Jung | |
| 2004/0082448 | A1 * | 4/2004 | Martin | A63B 21/4035 482/139 |
| 2005/0003931 | A1 * | 1/2005 | Mills | A63B 21/0601 482/5 |
| 2005/0037897 | A1 | 2/2005 | Chen | |
| 2005/0085352 | A1 * | 4/2005 | Baxter | A63B 21/0724 482/100 |
| 2005/0143232 | A1 * | 6/2005 | Hung | A63B 21/05 482/126 |
| 2005/0202942 | A1 * | 9/2005 | De Lano | A63B 21/0724 482/107 |
| 2006/0019800 | A1 * | 1/2006 | Berger | A61B 6/0421 482/46 |
| 2008/0176723 | A1 * | 7/2008 | Johnson | A63B 21/0724 482/106 |
| 2009/0075792 | A1 * | 3/2009 | Stugart | A63B 21/06 482/93 |
| 2009/0197741 | A1 | 8/2009 | Poillucci | |
| 2010/0160123 | A1 * | 6/2010 | Stugart | A63B 21/06 482/93 |
| 2011/0224054 | A1 * | 9/2011 | Bernstein | A63B 21/0004 482/110 |
| 2011/0287909 | A1 * | 11/2011 | Morris | A63B 21/0004 482/126 |
| 2013/0260969 | A1 * | 10/2013 | Huang | A63B 21/015 482/122 |
| 2017/0120104 | A1 | 5/2017 | Douglass | |

* cited by examiner

ARM EXERCISE ASSEMBLIES

BACKGROUND

1. Field of Inventions

The field of this application and any resulting patent is arm exercise assemblies.

2. Description of Related Art

Various arm exercise assemblies and methods for exercising human arms have been proposed and utilized, including some of the methods and structures disclosed in the references appearing on the face of this patent. However, those methods and structures lack the combination of steps and/or features of the methods and/or structures covered by the patent claims below. Furthermore, it is contemplated that the methods and/or structures covered by at least some of the claims of this issued patent solve many of the problems that prior art methods and structures have failed to solve. Also, the methods and/or structures covered by at least some of the claims of this patent have benefits that would be surprising and unexpected to a hypothetical person of ordinary skill with knowledge of the prior art existing as of the filing date of this application.

SUMMARY

The disclosure herein includes an arm exercise assembly, which arm exercise assembly may include: a frame shaped and sized to receive a human forearm; a piston coupled to the frame; a bracket pivotably coupled to the frame; a wheel coupled to the piston and pivotably coupled to the bracket; two locks extending radially through the wheel toward inner portions of the wheel; and a handle pivotably coupled to the wheel, wherein the handle may be capable of being abutted against one or both of the two locks.

The disclosure herein includes an arm exercise assembly, which arm exercise assembly may include: a frame shaped and sized to receive a human forearm; a piston coupled to the frame; a bracket pivotably coupled to the frame; a wheel coupled to the piston and pivotably coupled to the bracket, the wheel having an aperture; a first lock disposed in the aperture; a second lock disposed in the aperture; and a handle pivotably coupled to the wheel, wherein the handle may be capable of being abutted against the first lock, the second lock, or both.

The disclosure herein includes an arm exercise assembly, which arm exercise assembly may include: a frame shaped and sized to receive a human forearm; a piston coupled to the frame; a bracket pivotably coupled to the frame; a wheel coupled to the piston and pivotably coupled to the bracket, the wheel having an aperture; a first lock slidably coupled to the wheel; a second lock slidably coupled to the wheel; and a wheel coupled to the piston and pivotably coupled to the wheel, the handle comprising: a first portion abutted against the first lock; and a second portion abutted against the second lock.

The disclosure herein includes an arm exercise assembly, which arm exercise assembly may include: a frame shaped and sized to receive a human forearm; a bracket pivotably coupled to the frame; a wheel pivotably coupled to the bracket; a lock extending through the wheel towards a central axis of the wheel; and a handle pivotably coupled to the wheel, wherein the handle is capable of being abutted against the lock.

The disclosure herein includes a method of exercising an arm, which method may include: pulling a lock away from a central axis of a wheel of an arm exercise assembly; sliding a lock along a wheel; pushing the lock towards the central axis of the wheel; coupling the lock to the wheel; pivoting a handle pivotably coupled to the wheel; and pressing the handle against the lock.

DETAILED DESCRIPTION

1. Introduction

Figure 1:
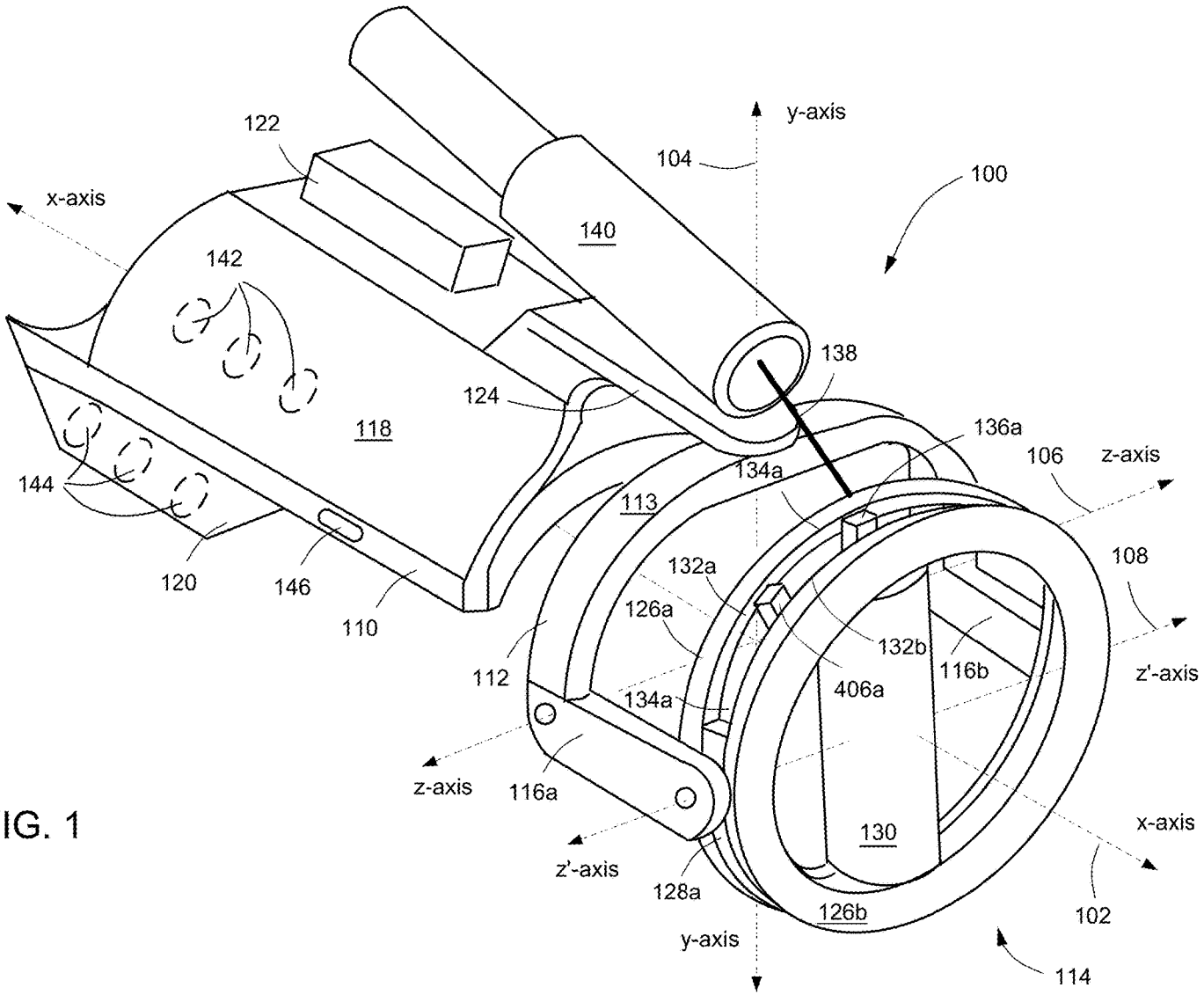
FIG. 1 illustrates a perspective view of an arm exercise assembly.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below. Each of the terms are defined to additionally encompass any structure identified as being in any of the drawings.

The term "abut against" as used herein as a verb is defined as position adjacent to and either physically touch or press against, directly or indirectly. After any abutting takes place with one object relative to another object, the objects may be fully or partially "abutted." A first object may be abutted against a second object such that the second object is limited from moving in a direction of the first object. For example, a portion of a handle may be abutted against a lock.

The term "adjacent" as used herein means next to and includes physical contact but does not require physical contact.

The term "align" as used herein as a verb is defined as manufacture, form, adjust, or arrange one or more physical objects into a particular position. After any aligning takes place, the objects may be fully or partially "aligned." Aligning preferably involves arranging a structure or a surface of a structure in linear relation to another structure or surface; for example, such that their borders or perimeters may share a set of parallel tangential lines. In certain instances, the aligned borders or perimeters may share a similar profile. Additionally, apertures may be aligned such that a structure or portion of a structure may be extended into and/or through the apertures.

The term "aperture" as used herein is defined as any opening in a solid object or structure, e.g., a frame, a wheel, a plate, a spacer, a housing, a plunger, a handle, a guide, a lock, and/or a tubular. For example, an aperture may be an opening that begins on one side of a solid object and ends on the other side of the object. An aperture may alternatively be an opening that does not pass entirely through an object but only partially passes through, e.g., as a groove. An aperture can be an opening in an object that is completely circumscribed, defined, or delimited by the object itself. Alternatively, an aperture can be an opening formed when one object is combined with one or more other objects or structures. An aperture may receive an object, e.g., pin, ball bearing, lock, portion of a lock, and/or a portion of a handle. For example, a portion of a lock and/or a handle may be received in an aperture of a wheel.

The term "arm exercise assembly" as used herein is defined as an assembly configured to resist movement of a human hand that is holding a portion of the assembly. An arm exercise assembly may be capable of receiving a human arm and hand. An arm exercise assembly may be strapped to a human arm. An arm exercise assembly may include a frame, a strap, a wheel, a plate, a spacer, a coil, a plunger, a handle, a guide, a lock, a piston, and/or a tubular.

The term "assembly" as used herein is defined as any set of components that have been fully or partially assembled together. A group of assemblies may be coupled to form a solid structure or a housing having an inner surface and an outer surface.

The term "coupled" as used herein is defined as directly or indirectly connected or attached. A first object may be coupled to a second object such that the first object is positioned at a specific location and orientation with respect to the second object. For example, a piston may be coupled to a frame. A first object may be either permanently, removably, slidably, threadably, and/or pivotably coupled to a second object. Two objects may be "removably coupled" to each other via locks, pins, threads, tape, latches, hooks, fasteners, locks, male and female connectors, clips, clamps, knots, and/or surface-to-surface contact. For example, a lock and wheel may be removably coupled to each other such that the lock may then be uncoupled and removed from the wheel. Two objects may be "slidably coupled" together, where one object is capable of being slid against a surface of a second object. For example, a lock slid through an aperture of a wheel and may be capable of being slid against the wheel is said to be slidably coupled to the wheel. Additionally, two objects may be capable of being "threadably coupled," e.g., where a threaded outer surface of one object is capable of being engaged with or to a threaded inner surface of another object. Threadably coupled objects may be removably coupled. Accordingly, a cap may be threadably coupled to a plunger of a lock where a threaded inner surface, e.g., box threads or female threads, of the plunger may be engaged with a threaded outer surface, e.g., pin threads or male threads, of the cap.

The term "cylindrical" as used herein is defined as having straight parallel sides and a circular or oval or elliptical cross-section, e.g., shaped like a cylinder. Examples of a cylindrical structure or object include a plate, a pipe, a spacer, a housing, a plunger, a handle, a guide, a lock, and a tubular. A cylindrical object may be completely or partially shaped like a cylinder. For example, a wheel may have an aperture that extends through the entire length of the wheel to form a hollow cylinder capable of permitting another object, e.g., a handle and/or a human hand, to be extended or passed through. Alternatively, a solid cylindrical object may have an inner surface or outer surface having a diameter that changes abruptly. A cylindrical object may have and inner or outer surface having a diameter that changes abruptly to form a "lip," e.g., flange, face, collar, or rim. A cylindrical object may have a collar extending towards or away from the central axis line of the object. A cylindrical object may have a collar disposed on its inner surface. A cylindrical object may have a collar disposed on its outer surface. Additionally, a cylindrical object, may have a collar that is tapered or radiused.

The term "electrode" as used herein is defined as a structure on or through which electricity is capable of being conducted. An electrode may be made from conductive material, e.g., carbon-based, metal-based, or metal oxide-based. A carbon-based electrode may be, e.g., made from polyacrylonitrile-based carbon fibers, pitch-based carbon fibers, rayon-based carbon fibers, vitreous carbon, carbon nanotubes (CNTs), carbon nanocoils, carbon nanowires, carbon nanofibers, carbon whiskers, and/or graphite fibrils. An electrode may be, e.g., a strip of polymer that includes polypyrroles, polythiophenes, polyanilines, polyacetylenes, poly-p-phenylenes, and derivatives thereof. Types of polythiophene polymers may include poly (3,4-ethylenedioxy thiophene) (PEDT) and poly (styrenesulfonate) (PEDOT-PSS). A metal-based electrode may be one or more fibers or nanowires made from metal or alloy, e.g., gold, platinum, silver, nickel, silicon, stainless steel, copper, brass, aluminum, zirconium, hafnium, Vanadium, niobium, tantalum, chromium, molybdenum, manganese, technetium, rhenium, iron, osmium, cobalt, zinc, scandium, boron, gallium, indium, silicon, germanium, tin, magnesium, etc. A metal oxide-based electrode may be one or more fibers or nanowires made from metal oxide or metal oxide composites. An electrode may be woven into fabric lining of a brace of an arm exercise assembly. An electrode may be coupled to an inner surface of a brace of a frame. An electrode may include a plug. A printer may print and/or spray conductive material onto a surface to form an electrode thereon. An electrode may be coupled to a power supply, e.g., one or more batteries.

The terms "first" and "second" as used herein merely differentiate two or more things or actions, and do not signify anything else, including order of importance, sequence, etc.

The term "frame" as used herein is defined as a structure, preferably a cylindrical structure, preferably configured to receive a human forearm, fully or partially. A frame may have an upper brace and a lower brace. A frame may have bracket having the shape of a half of a cylinder cut parallel to its central axis. In other words, a frame may have a bracket having the shape of a block-letter "C." A frame may have an upper brace and a lower brace are coupled. A frame may have an upper brace and a lower brace that are unitary. A frame may have an upper brace and a lower brace that form a cylindrical structure. A frame may have a brace having an inner surface abutted against a human forearm.

The term "groove" as used herein is defined as an indentation in a surface or the space defined by two intersecting curved or planar surfaces at an angle, e.g., a channel. A groove may extend in a straight line from one end to another. A groove may be a continuous loop, e.g., around a cylindrical structure. A groove may extend in a meandering path from an end to another, e.g., a S-shaped or C-shaped path. A groove may have a cross-section that is V-shaped or L-shaped. A groove may have a cross-section that is rectangular. A groove may have a cross-section that is arcuate, e.g., U-shaped.

The term "guide" as used as a noun herein is defined as a structure, preferably a cylindrical structure, configured to be slid or disposed within or into a wheel. A guide may be curved. A guide may be coupled to a handle. A guide and a handle may be unitary. A guide may have an end abutted against a coil. A guide may have a first end abutted against a first coil and a second end abutted against a second coil.

The term "handle" as used as a noun herein is defined as a structure, preferably a cylindrical structure, configured to be gripped by a human hand. A handle may have one or more posts. A handle may have a post coupled to a guide. A handle may have a post and a guide that are unitary. A handle may have a guide disposed in a channel of a wheel. A handle may have a portion abutted against a lock. A handle may have a portion abutted against a pressure sensor. A handle may be disposed between two locks. A handle may have a post disposed between two locks. A handle may have a guide disposed between two locks.

The terms "he," "she," "they," and any other personal pronouns as used herein refer to any gender interchangeably. For example, all uses of "he" encompasses "she" as well.

The term "housing" as used herein is defined as a structure, preferably a cylindrical structure, configured to receive another object or structure, fully or partially. For example, a housing may be configured to receive a plunger and/or one or more pins. The pins may have portions extending through the housing. A housing may be part of a lock. A housing may have one or more apertures extending therethrough. A housing may have one or more threaded ends for coupling with another housing. Multiple housings may be coupled axially to form a longer housing. A housing may receive another object or structure, e.g., plunger and/or pin, therein. A housing and an object or structured, e.g., plunger, disposed therein may be concentric.

The term "lock" as used herein as a noun is defined as a structure capable of inhibiting movement of an object. For example, a lock may be used to inhibit movement, e.g., pivoting or rotation, of a handle. A lock may include a housing, a plunger, a plurality of pins, e.g., balls, ball bearings, pegs, or rods. A lock may include one or more pins disposed in a housing. A lock may include a pin disposed in a groove of a plate of wheel.

The term "motor" as used herein is defined as an assembly for driving movement and/or vibration of an object, e.g., handle. Movement of an object may include vibration of the object. A motor may be coupled to a power supply, e.g. one or more batteries.

The term "pin" as used herein is defined as a structure capable of being received in an aperture, e.g., groove, of another structure. A pin may be capable of coupling two objects. For example, a pin may couple a lock to a wheel. A pin may be capable of inhibiting movement of an object. For example, a pin of a lock pressed into a groove of a wheel may inhibit movement of the lock relative to the wheel. A pin may be a ball, a rod, a peg, or a cone.

The term "pivot" as used as a verb herein is defined as turn, e.g., move, rotate, swivel, revolve, and/or spin around a point. After any pivoting takes place with an object, the object may be "pivoted."

The term "piston" as used herein is defined as a structure or an assembly configured to resist force applied thereto. A piston may include a housing, a piston rod, and a coil. The piston rod and the coil may be disposed in the housing. The piston rod may be slidably coupled to the housing. The coil may be disposed between the piston rod and an inner surface of the housing. The coil may be abutted against the piston rod and an inner surface of the housing. The coil may push the piston rod and the housing in opposite directions. Thus, when the piston rod is pushed or pulled against the coil, the coil would resist movement of the piston rod. A piston may be coupled to a frame and a wheel of an arm exercise assembly. A piston may have a piston rod couple to a wheel via a cable, a rod, a wire, or a string.

The term "plate" as used herein is defined as a flat structure. A plate may be formed from a flat piece of metal, ceramic, wood, plastic, carbon fiber, or fiber glass. A plate may be capable of being coupled to a spacer. A front plate may cover internal components of an arm exercise assembly in front, e.g., spacers, coils, locks, portions of a handle, or sensors. A back plate may cover internal components of an arm exercise assembly from behind. A plate may have an inner surface, an outer surface, one or more apertures, and/or one or more grooves. A plate may have an inner surface and an outer surface, wherein the portions of a lock may be removably coupled to the inner surface of the plate. A plate may have an inner surface and an outer surface, wherein one or more spacers may be in physical contact with the inner surface of the plate. A plate may have an inner surface and an outer surface, wherein a threaded assembly may be in physical contact with outer surface of the plate.

The term "pressure" as used herein is defined as force per unit area. Pressure may be exerted against a surface of a first object, e.g., lock and/or pressure sensor, by a second object, e.g., handle.

The term "provide" as used herein as verb is defined as make available, furnish, supply, equip, or cause to be placed in position.

The term "protrusion" as used herein is defined as a structure and/or projection extending from an object or structure. A protrusion may be received in an aperture. An object may be coupled to a protrusion. For example, a piston may be coupled to a protrusion of a frame of an arm exercise assembly. Additionally, a bracket may be coupled to protrusion of a frame of an arm exercise assembly.

The term "push" as used as a verb herein is defined as apply force e.g., towards and/or against an object or structure, directly or indirectly. Pushing may compel, e.g., urge, cause, influence, force, and/or press, displacement of an object; however, the object may or may not be displaced. A first object pushing a second object may transfer force to the second object. For example, a person pushing a portion, e.g., post, of a handle against a pressure sensor may transfer force to the pressure sensor. A first object pushing a second object may cause the second object to push a third object, directly or indirectly. For example, a person pushing a portion, e.g., post and/or a guide, of a handle against a coil may cause the coil to push against a lock, directly or indirectly. A first object directly pushing a second object may physically touch the second object. A first object indirectly pushing a second object may physically touch a medium that physically touches the second object; the medium may be a structure, e.g., coil, guide, washer, spacer, or seal.

The term "plunger" as used herein is defined as a structure configured for actuating a lock. A plunger may have a stem. A plunger may have a stem having a tapered profile. A plunger may have a stem having a diameter smaller than that of the rest of the plunger. A plunger may have a radiused portion. A plunger and a stem may be two separate pieces that are coupled, e.g., via threads, welding, glue, or melting. A plunger may have a cap coupled to each end of the plunger.

The term "radiused" as used herein is defined as having a contour that is curved, semicircle, and/or hemispherical. Radiused surfaces may be concave or convex.

The term "screen" as used herein means a structure configured to display text, characters, symbols, and/or images. A screen is preferably coupled to a plate of a wheel. A screen may extend through a plate of a wheel. A screen is preferably flat. A screen can be flexible or rigid.

A screen can have any of a variety of shapes, and is preferably rectangular or square, but may also be elliptical or circular.

The term "sleeve" as used herein is defined as a tubular configured for removable coupling to a handle. A sleeve may have a diameter greater than that of a handle. A sleeve may be constructed from various material, e.g., rubber, plastic, carbon fiber, fiber glass, wood, or metal. A sleeve may be coupled to a handle. A sleeve may be cylindrical. A sleeve may have a cut, e.g., opening, extending longitudinally from the ends of the sleeve. Thus, a handle may be inserted through the cut in the sleeve. Accordingly, the sleeve may be removably wrapped around the handle. When couple to a handle, a sleeve would increase the diameter of the handle.

The term "spacer" as used herein is defined as any solid or semi-solid structure. Preferably, a spacer is a structure capable of being removably coupled to an inner surface of a plate. More preferably, a spacer is coupled to two plates with opposing surfaces that face one another. In some cases, removable coupling of a spacer to a plate may prevent the plate from shifting or separating relative to the spacer, or at least substantially inhibit such movement. A spacer may be an arcuate wall (see, e.g., 128, FIG. 3 and FIG. 4). In certain cases, multiple arcuate walls (spacers) may be located in certain spaces between different assemblies that are part of an exercise assembly. A spacer may be a wall or may alternatively be a cylindrical, polygonal, and/or irregular structure, or a tubular structure, rod, polygonal cube, or walls having irregular contours. A spacer may be elongated. A spacer may be solid. A spacer may alternatively be formed from multiple smaller, interconnected subunits, and preferably remains rigid.

The term "strap" as used herein means a flexible structure, e.g., configured for fastening and/or coupling a human forearm to an arm exercise assembly. A strap may be continuous. A strap may be flat and may have a long side and a short side. A strap may be constructed from any one of various materials, e.g., leather, Kevlar, cotton, and/or hemp. A strap may be folded into adjacent segments capable of being coupled (e.g., via Velcro, a hoop, or a ring) to form two or more plies. A strap may be constructed from to separate strap segments sutured to together.

The term "surface" as used herein is defined as any face of a structure. A surface may also refer to that flat or substantially flat area that is extended radially around a cylinder which may, for example, be part of a rotor or bearing assembly. A surface may also refer to that flat or substantially flat area that extend radially around a cylindrical structure or object which may, for example, be part of a plate, a spacer, a housing, a plunger, a handle, a guide, a lock, and/or a tubular. A surface may have irregular contours. A surface may be formed from coupled components, e.g., a plate, a spacer, a housing, a plunger, a handle, a guide, a lock, and/or a tubular. Coupled components may form irregular surfaces. A plurality of surfaces may be connected to form a polygonal cross-section. An example of a polygonal cross-section may be triangular, square, rectangular, pentagonal, hexagonal, or octagonal.

The term "tapered" as used herein is defined as extending from a first point to a second point while become progressively smaller, e.g., in radius, and/or thinner from the first point to the second point. Structures that are tapered may have a profile that is beveled, frustoconical, and/or conical. Structures that are tapered may be cylindrical.

The term "threaded" as used herein is defined as having threads. Threads may include one or more helical protrusions or grooves on a surface of a cylindrical object. Each full rotation of a protrusion or groove around a threaded surface of the object is referred to herein as a single "thread." Threads may be disposed on any cylindrical structure or object including a wheel, a plate, a spacer, a housing, a plunger, a handle, a guide, a lock, and/or a tubular. Threads formed on an inner surface of an object may be referred to as "box threads." Threads formed on an outer surface of an object may be referred to as "pin threads." A threaded assembly may include a "threaded portion" wherein a section of the threaded assembly includes threads, e.g., pin threads or box threads. A threaded portion may have a diameter sized to extend through an aperture of a wheel, a plate, a spacer, a housing, a plunger, a handle, a guide, a lock, and/or a tubular. In certain cases, a threaded portion of a first object may be removably coupled to a threaded portion of a second object.

The term "threaded assembly" as used herein is defined as an assembly that includes threads, and preferably also includes one or more nuts, one or more bolts, one or more washers, and/or one or more spacers used for coupling two objects together. A nut, a washer, and a spacer may, for example, share a common central axis line. A nut may have a threaded inner surface that may mesh with outer threads on an object, e.g., threaded portion of a bolt or screw.

The term "tubular" as used herein is defined as a structure having an inner surface and an outer surface. A tubular may have an aperture disposed therethrough. Preferably, a tubular is cylindrical. Examples of a tubular may a wheel, a plate, a spacer, a housing, a plunger, a handle, a guide, and/or a lock. However, any or all tubulars of an assembly may have polygonal cross-sections, e.g., triangular, rectangular, pentagonal, hexagonal, or octagonal.

The term "unitary" as used herein defined as having the nature, properties, or characteristics of a single unit. For example, a handle and a frame that are individual parts of a frame may be unitary in the sense they are not separate but rather are formed from a single piece of material, e.g., rubber, plastic, carbon fiber, ceramic, or metal. In another example, a post and a guide that are individual parts of a handle may be unitary in the sense they are not separate but rather are formed from a single piece of material, e.g., plastic, carbon fiber, ceramic, or metal.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a frame, a wheel, a plate, a spacer, a housing, a plunger, a handle, a guide, a lock, a piston, and/or a tubular may each have an upper end and a lower end. Additionally, a cylindrical object, e.g., a, a frame, a wheel, a plate, a spacer, a housing, a plunger, a handle, a guide, a lock, a piston, and/or a tubular, may have an upper portion and a lower portion. The term "top" as used herein means in the highest position, e.g., farthest from the ground. The term "bottom" as used herein means in the lowest position, e.g., closest the ground. For example, a cylindrical object, e.g., a, a frame, a wheel, a plate, a spacer, a housing, a plunger, a handle, a guide, a lock, a piston, and/or a tubular, may have a top portion and a bottom portion.

The term "wheel" as used herein is defined as a structure configured for coupling to a frame, a handle, and/or one or more locks. A wheel may be pivotably coupled to a bracket. A wheel may be cylindrical. A wheel may be tubular. A wheel may include two plates and two spacers. A wheel may have grooves. A wheel may have apertures configured to receive one or more portions of a handle, one or more locks, and/or coils. A wheel may have a plate having pairs of grooves disposed therein. A wheel may have pairs of grooves positioned 12, 13, 14, 15, 16, 17 or 18 degrees apart relative to the central axis of the wheel. Preferably, a wheel has pairs of grooves positioned 15 degrees apart relative to the central axis of the wheel. A wheel may have a central axis point and pairs of grooves each having a central axis, wherein the central axes form an angle ranging from 0. 0.2094 radian, 0.226893 radian, 0.2443 radian, 0.2618 radian, 0.2792 radian, 0.2967 radian to 0.3141 radian, or larger. Preferably, a wheel has a central axis point and pairs of grooves each having a central axis, wherein the central axes form an angle that is 0.2618 radian.

3. Certain Specific Embodiments

The disclosure herein includes an arm exercise assembly, which arm exercise assembly may include: a frame shaped and sized to receive a human forearm; a piston coupled to the frame; a bracket pivotably coupled to the frame; a wheel coupled to the piston and pivotably coupled to the bracket; two locks extending radially through the wheel toward inner portions of the wheel; and a handle pivotably coupled to the wheel, wherein the handle may be capable of being abutted against one or both of the two locks.

The disclosure herein includes an arm exercise assembly, which arm exercise assembly may include: a frame shaped and sized to receive a human forearm; a piston coupled to the frame; a bracket pivotably coupled to the frame; a wheel coupled to the piston and pivotably coupled to the bracket, the wheel having an aperture; a first lock disposed in the aperture; a second lock disposed in the aperture; and a handle pivotably coupled to the wheel, wherein the handle may be capable of being abutted against the first lock, the second lock, or both.

The disclosure herein includes an arm exercise assembly, which arm exercise assembly may include: a frame shaped and sized to receive a human forearm; a piston coupled to the frame; a bracket pivotably coupled to the frame; a wheel coupled to the piston and pivotably coupled to the bracket, the wheel having an aperture; a first lock slidably coupled to the wheel; a second lock slidably coupled to the wheel; and a wheel coupled to the piston and pivotably coupled to the wheel, the handle comprising: a first portion abutted against the first lock; and a second portion abutted against the second lock.

The disclosure herein includes an arm exercise assembly, which arm exercise assembly may include: a frame shaped and sized to receive a human forearm; a bracket pivotably coupled to the frame; a wheel pivotably coupled to the bracket; a lock extending through the wheel towards a central axis of the wheel; and a handle pivotably coupled to the wheel, wherein the handle is capable of being abutted against the lock.

The disclosure herein includes a method of exercising an arm, which method may include: pulling a lock away from a central axis of a wheel of an arm exercise assembly; sliding a lock along a wheel; pushing the lock towards the central axis of the wheel; coupling the lock to the wheel; pivoting a handle pivotably coupled to the wheel; and pressing the handle against the lock.

In any one of the methods or structures disclosed herein, the frame may be cylindrical.

In any one of the methods or structures disclosed herein, the frame may include: an upper brace; and a lower brace coupled to the upper brace.

In any one of the methods or structures disclosed herein, the frame may include an upper brace having a brace handle.

In any one of the methods or structures disclosed herein, the bracket may be coupled to an upper brace of the frame.

In any one of the methods or structures disclosed herein, the bracket is coupled to a protrusion of the frame.

In any one of the methods or structures disclosed herein, the bracket may be pivotable relative to the frame.

In any one of the methods or structures disclosed herein, the wheel may be pivotable relative to the bracket.

In any one of the methods or structures disclosed herein, the handle may further include a post capable ingress, egress, or both, through an aperture of the handle.

In any one of the methods or structures disclosed herein, the lock may be removably coupled to the wheel.

In any one of the methods or structures disclosed herein, the lock may have a portion extended into a groove of the wheel.

In any one of the methods or structures disclosed herein, the lock may have a portion capable of ingress into or egress from a groove of the wheel.

In any one of the methods or structures disclosed herein, the arm exercise assembly may further include a guide coupled to the handle.

In any one of the methods or structures disclosed herein, the arm exercise assembly may further include a guide slidably disposed in the wheel, wherein the guide is coupled to the handle.

In any one of the methods or structures disclosed herein, the arm exercise assembly may further include comprising a coil disposed in the wheel.

In any one of the methods or structures disclosed herein, the arm exercise assembly may further include: a guide coupled to the handle; and a coil disposed between the guide and the lock.

In any one of the methods or structures disclosed herein, the arm exercise assembly may further include a strap coupled to the frame.

In any one of the methods or structures disclosed herein, the arm exercise assembly may further include a strap coupled to a lower brace of the frame.

In any one of the methods or structures disclosed herein, the arm exercise assembly may further include a piston coupled to the frame and the wheel.

In any one of the methods or structures disclosed herein, the arm exercise assembly may further include a piston coupled to the frame, the piston having a cable coupled to the wheel.

In any one of the methods or structures disclosed herein, the arm exercise assembly may further include a sleeve removably coupled to the handle.

In any one of the methods or structures disclosed herein, the arm exercise assembly may further include a sleeve having a diameter greater than a diameter of the handle.

In any one of the methods or structures disclosed herein, the arm exercise assembly may further include a pressure sensor coupled to the lock.

In any one of the methods or structures disclosed herein, the arm exercise assembly may further include a pressure sensor disposed between the lock and the first post of the handle.

In any one of the methods or structures disclosed herein, the arm exercise assembly may further include a pressure sensor capable of being abutted against the handle.

In any one of the methods or structures disclosed herein, the arm exercise assembly may further include a pressure sensor capable of being abutted against a post of the handle.

In any one of the methods or structures disclosed herein, the arm exercise assembly may further include: a pressure sensor coupled to the lock; and a screen electrically coupled to the pressure sensor.

In any one of the methods or structures disclosed herein, the arm exercise assembly may further include: a pressure sensor coupled to the lock; and a screen electrically coupled to the pressure sensor and coupled to the wheel.

In any one of the methods or structures disclosed herein, the wheel may include a pair of grooves, wherein the pair of grooves and a central axis of the wheel define an angle between 0.2094 radian and 0.3141 radian.

In any one of the methods or structures disclosed herein, the wheel wheel may include a pair of grooves, wherein the pair of grooves may be between 12 to 18 degrees apart relative to a central axis of the wheel.

In any one of the methods or structures disclosed herein, the handle has a portion disposed between the first lock and the second lock.

In any one of the methods or structures disclosed herein, the wheel may further include: a first coil capable of being abutted against the handle and the first lock; and a second coil capable of being abutted against the handle and the second lock.

In any one of the methods or structures disclosed herein, the wheel may further include: a first plate; and a second plate, wherein the first lock and the second lock may be disposed between the first plate and the second plate.

In any one of the methods or structures disclosed herein, the wheel may further include: a first plate having a first groove; and a second plate having a second groove aligned with the first groove, wherein a lock may be disposed between the first groove and the second groove.

Any one of the methods disclosed herein may further include pivoting the handle on the central axis of the wheel.

Any one of the methods disclosed herein may further include pivoting a bracket relative to a frame.

Any one of the methods disclosed herein may further include pivoting the wheel relative to a bracket.

Any one of the methods disclosed herein may further include pulling a piston.

Any one of the methods disclosed herein may further include holding a brace handle.

Any one of the methods disclosed herein may further include strapping a human forearm to a frame.

Any one of the methods disclosed herein may further include pushing the handle against a pressure sensor.

Any one of the methods disclosed herein may further include pushing the handle against a pressure sensor coupled to the wheel.

Any one of the methods disclosed herein may further include transferring electric current through an electrode.

Any one of the methods disclosed herein may further include actuating a motor disposed on the handle.

Any one of the methods disclosed herein may further include resisting, with a coil, the pressing of the pressing of handle against the lock.

Any one of the methods disclosed herein may further include displaying, on a screen, an amount of pressure being pressed against the pressure sensor.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of arm exercise assemblies shown in the drawings, which relate to assemblies, elements and parts that can be part of an arm exercise assembly, and methods for developing and strengthening human arms. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the methods, structures, elements, and parts described herein have been described in detail, it should be understood that various changes, substitutions, and alterations can be made without departing from the spirit and scope of the inventions as defined by the following claims. Those skilled in the art may be able to study the preferred embodiments and identify other ways to practice the inventions that are not exactly as described herein. It is the intent of the inventor that variations and equivalents of the inventions are within the scope of the claims, while the description, abstract and drawings are not to be used to limit the scope of the inventions. The inventions is specifically intended to be as broad as the claims below and their equivalents.

FIG. 1 illustrates a perspective view of an arm exercise assembly 100. The arm exercise assembly 100 is a solid object or structure. Therefore, the arm exercise assembly 100 may be illustrated on a three-dimensional coordinate system having an x-axis 102 (length), y-axis 104 (height), and z-axis 106 (depth). Additionally, the x-axis 102 of the arm exercise assembly 100 may also be the central axis 102 of the arm exercise assembly 100. Thus, the x-axis 102 and the central axis 102 of the arm exercise assembly may be used interchangeably.

Figure 2:
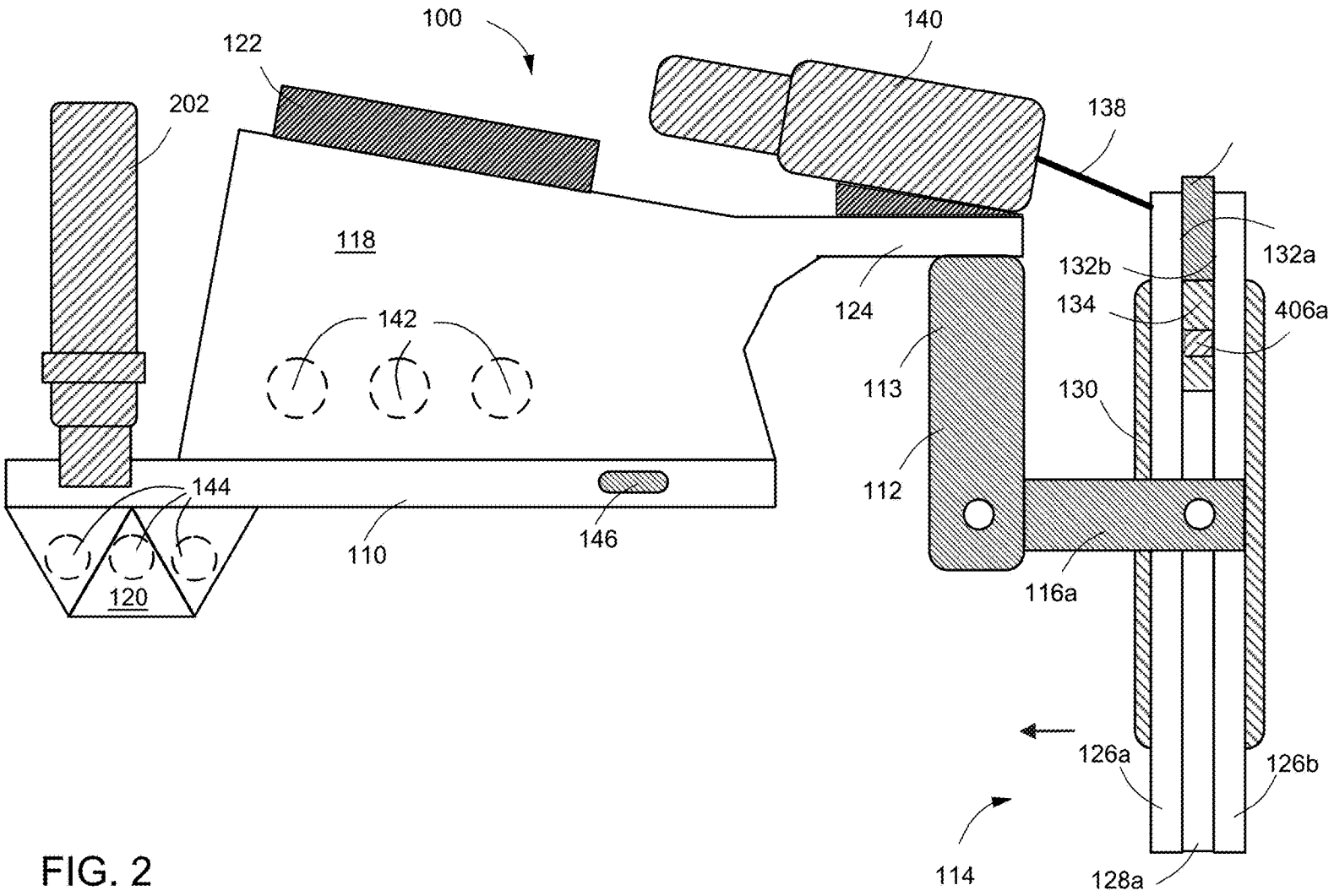
FIG. 2 illustrates a side view of an arm exercise assembly.

Referring to FIG. 1 and FIG. 2, the arm exercise assembly 100 may include a frame 110, a bracket 112, and a wheel 114. The frame 110 may include an upper brace 118, a lower brace 120, a brace handle 122, and a protrusion 124. The upper brace 118 may have one or more electrodes 142 disposed thereon. The one or more electrodes 142 may be disposed on an inner surface of the upper brace 118. The lower brace 120 may have one or more electrodes 144 disposed thereon. The one or more electrodes 144 may be disposed on an inner surface of the lower brace 120. The electrodes 142, 144 may be coupled to a power supply (not shown). The power supply may be one or more batteries. The power supply may be coupled to a switch 146.

The brace handle 122 may extend from the upper brace 118, e.g., perpendicular to the x-axis 102. The brace handle 122 and the upper brace 118 may be unitary.

The protrusion 124 may extend from the upper brace 118 e.g., parallel to the x-axis 102. The protrusion 124 and the upper brace 118 may be unitary.

The bracket 112 may be pivotably coupled to the protrusion 124 of the frame 110. The bracket 112 may have an arch 113. The arch 113 may be pivotably coupled to the protrusion 124 via a pin, screw, or bolt. Accordingly, the bracket 112 may be pivoted on the y-axis 104. In other words, the bracket 112 may be pivoted lateral to, e.g., to a side of, the arch 113.

Additionally, the bracket 112 may have arms 116*a*, 116*b*. The arms 116*a*, 116*b* may be pivotably coupled to the arch 113. The arms 116*a*, 116*b* may be pivoted on the z-axis 106 relative to the arch 113. In other words, the arms 116*a*, 116*b* may be pivoted up and/or down relative to the frame 110.

The arms 116*a*, 116*b* may be pivotably coupled to the wheel 114. Each arm 116 may be coupled to a side of the wheel 114. Accordingly, the wheel 114 may be pivoted on a z'-axis 108. In other words, the wheel 114 may be pivoted up and/or down relative to the bracket 112.

Figure 3:
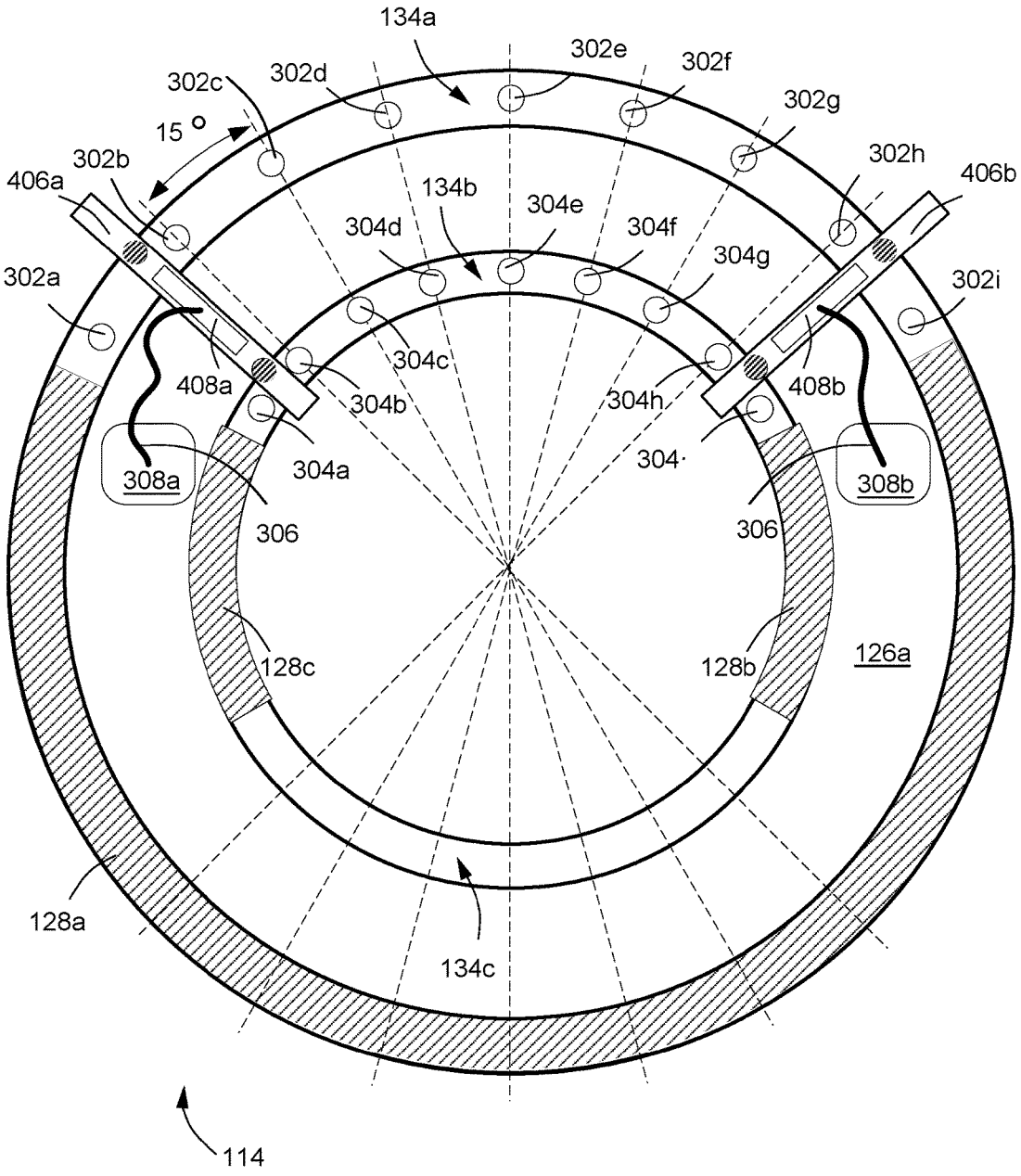
FIG. 3 illustrates a cross-sectional view of a wheel.

In addition, the wheel 114 may include plates 126*a*, 126*b*, an outer spacer 128*a*, and inner spacers 128*b*, 128*c* (FIG. 3). The plates 126*a*, 126*b* may be circular. Each plate 126 may have an aperture dispose therethrough. The apertures in the plates 126*a*, 126*b* may be aligned. Thus, a human hand may extend through the apertures.

The plates 126*a*, 126*b* may be coupled (via bolts or screws) to the spacers 128*a-c*. Inner surfaces 132*a*, 132*b* of the plates the plates 126*a*, 126*b* and the outer spacer 128*a* may define an outer aperture 134*a*. The inner surfaces 132*a*, 132*b* and the inner spacers 128*b*, 128*c* may define a first inner aperture 134*b* and a second inner aperture 134*c* (see FIG. 3 and FIG. 4).

The handle 130 may have a first post 136*a* disposed between the plates 126*a*, 126*b* and ends of the outer spacer 128*a*. In other words, the first post 136*a* may be disposed through the outer aperture 134*a* because the plates 126*a*, 126*b* and the outer spacer 128*a* may define the outer aperture 134*a*. The first post 136*a* may be slid within the aperture 134*a*, 134*b* along the inner surfaces 132*a*, 132*b* of the plates 126*a*, 126*b*.

In addition, the arm exercise assembly 100 may include a piston 140. The piston 140 may be coupled to the upper brace 118. The piston 140 may include a cable 138. The cable 138 may be coupled (via a hook, bolt, or screw) to the wheel 114. The cable 138 may be coupled to an outer surface of the plate 126*a*. The outer surface may be opposite the inner surface 132*a* of the plate 126*a*. The piston 140 may provide resistance to movement of the wheel 114.

Referring to FIG. 2, the arm exercise assembly 100 may include a strap 202. The strap 202 may be coupled to the frame 110. The strap 202 may be couple to the lower brace 120 of the frame 110.

FIG. 3 illustrates a cross-sectional view of a wheel 114. The wheel 114 may include a first plate 126*a*, a second plate 126*b* (FIG. 1 and FIG. 2), an outer spacer 128*a*, and inner spacers 128*b*, 128*c*. The second plate 126*b* is omitted to illustrate internal components of the wheel 114. The plates 126*a*, 126*b* may be circular. Furthermore, the plates 126*a*, 126*b* may be coupled to the spacers 128*a-c*.

The first plate 126*a* may have a first set of grooves 302*a-i*. Each groove 302 may extend laterally through the first plate 126*a*, completely or partially. Each adjacent pair of grooves 302 may have central axes spaced 15 degrees apart relative to the central axis of the first plate 126*a*. For example, the central axis of the groove 302*b* and the central axis of the groove 302*c* may be spaced 15 degrees apart relative to the central axis of the first plate 126*a*. In other words, the angle formed by the central axis of the groove 302*b*, the central axis of the groove 302*c*, and the central axis of first plate 126*a* may form an angle that is 0.2618 radian.

Also, the first plate 126*a* may have a second set of grooves 304*a-i*. Each groove 304 may extend laterally through the first plate 126*a*, completely or partially. Each adjacent pair of groove 304 may have central axes spaced 15 degrees apart relative to the central axis of the first plate 126*a*. For example, the central axis of the groove 304*b* and the central axis of the groove 304*c* may be spaced 15 degrees apart relative to the central axis of the first plate 126*a*. In other words, the angle formed by the central axis of the groove 304*b*, the central axis of the groove 304*c*, and the central axis of the first plate 126*a* may form an angle that is approximately 0.2618 radian.

Although not shown, it should be understood that the second plate 126*b* may have a first set of grooves 302*a*'-i' corresponding to the first set of grooves 302*a-i* of the first plate 126*a*. Also, the second plate 126*b* may have a second set of grooves 304*a*'-i' corresponding to the second set of grooves 304*a-i* of the first plate 126*a*.

In addition, screens 308*a*, 308*b* be may be coupled to the first plate 126*a*. The screens 308*a*, 308*b* may be configured to face towards a frame 110 (FIG. 1) of the arm exercise assembly 100. Each screen 308 may be electrically connected (via electrical wires 306) to a pressure sensor 408. Each screen 308 would display the amount of pressure applied to a respective pressure sensor 408. For example, when the handle 106 is abutted against the pressure sensor 408, the pressure sensor 408 may send a signal, e.g., via an electric wire, to a respective screen 308. The screen 308 would display a number corresponding to the pressure applied to pressure sensor 408.

Figure 4:
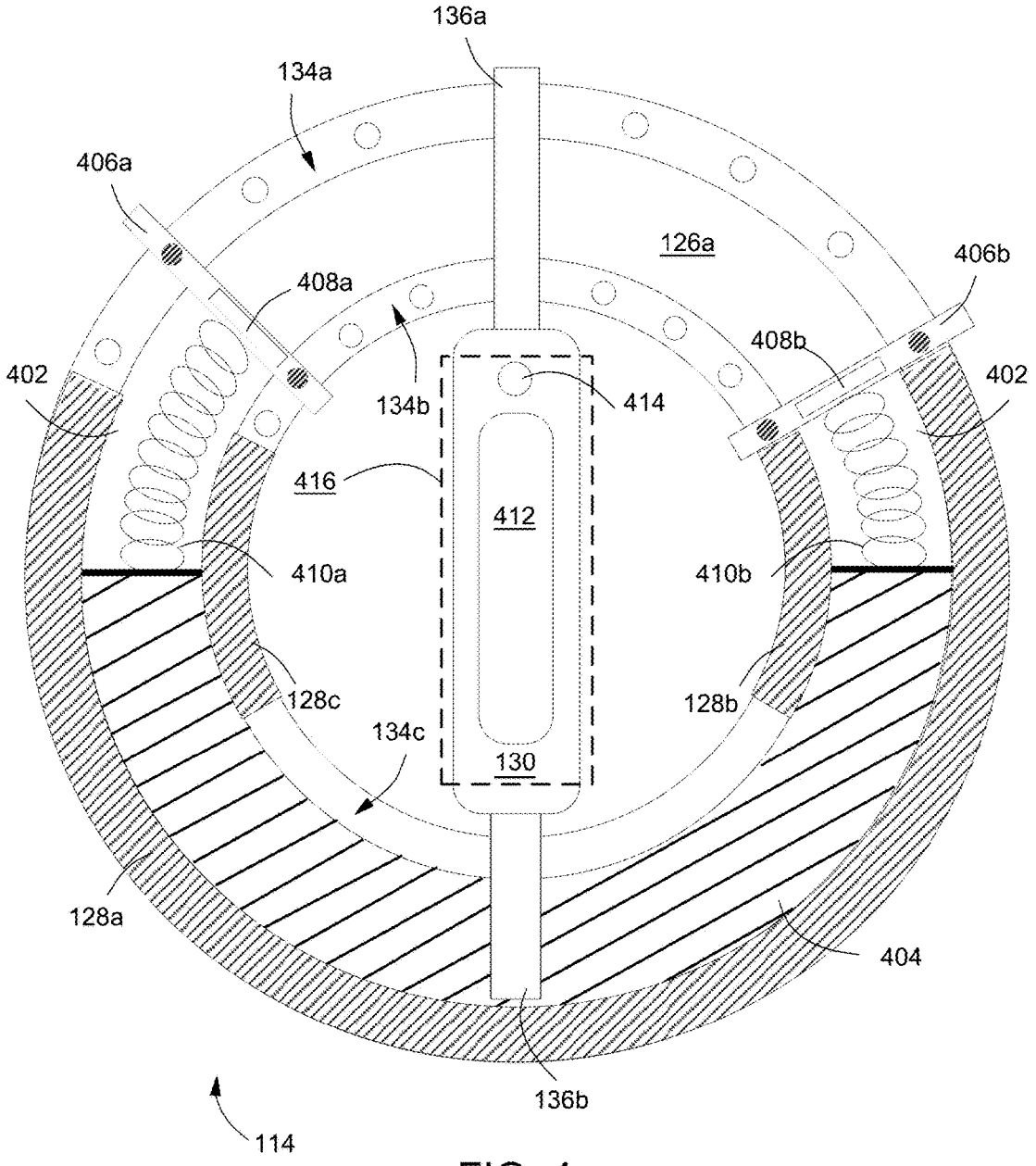
FIG. 4 illustrates a cross-sectional view of a handle and locks coupled to a wheel.

FIG. 4 illustrates a cross-sectional view of a handle 130 and locks 406*a*, 406*b* coupled to a wheel 114. The wheel 114 may include a first plate 126*a*, a second plate 126*b* (FIG. 2), an outer spacer 128*a*, and inner spacers 128*b*, 128*c*. The first plate 126*a* may be coupled to one end of each the spacers 128*a-c*. Although omitted to illustrate internal components of the wheel 114, the second plate 126*b* may be coupled to an opposite end of each of the spacers 128*a-c*. The plates 126*a*, 126*b* may be coupled to the spacers 128*a-c* via bolts or screws. The first plate 126*a*, the second plate 126*b*, the outer spacer 128*a*, and the inner spacers 128*b*, 128*c* may define a channel 402, an outer aperture 134*a*, and a first inner aperture 134*b*, and a second inner aperture 134*c*.

A first post 136*a* of the handle 130 may extend though the apertures 134*a*, 134*b*. In other words, the first post 136*a* may be disposed between inner surfaces 132*a*, 132*b* of the plates 126*a*, 126*b*, the outer spacer 128*a*, and the inner spacers 128*b*, 128*c*. A second post 136*b* of the handle 130 may extend though the second inner aperture 134*c*. In other words, the second post 136*b* may be disposed between inner surfaces 132*a*, 132*b* of the plates 126*a*, 126*b* and the inner spacers 128*b*, 128*c*.

Accordingly, the posts 136*a*, 136*b* may be slid along the inner surfaces 132*a*, 132*b* of the plates 126*a*, 126*b*, respectively. Thus, the handle 130 may be pivotably coupled to the wheel 114. Moreover, the handle 130 may be pivoted on an x-axis 102 (see FIG. 1) of the arm exercise assembly 100.

In addition, a motor 412 may be disposed on or in the handle 130. The motor 412 may be electrically couple to a power supply (not shown) and a switch 414. The power supply and/or the switch 414 may also be disposed on or in the handle 130.

Furthermore, each lock 406 may have a pressure sensor 408 coupled thereto. Each pressure sensor 408 may be electrically connected (via an electrical wire 306) to a screen 308 (FIG. 3).

The handle 130 may have a guide 404. The guide 404 may be disposed in the channel 402. The guide 404 may be slid in the channel 402. A post 136*b* of the handle 130 may be coupled to the guide 404. In some versions, the handle 130 and the guide 404 may be unitary.

A first lock 406*a* and a second lock 406*b* may be disposed in the outer aperture 134*a*. In addition, the first lock 406*a* and the second lock 406*b* may be disposed in the first inner aperture 134*b*. The locks 406*a*, 406*b* may each have a portion, e.g., ball bearing, peg, rod, or pin, extended into a respective first groove 302 in each of the plates 126*a*, 126*b* (see FIGS. 5A-B). The locks 406*a*, 406*b* may each have a portion, e.g., ball bearing, peg, rod, or pin, extended into a respective second groove 304 in each of the plates 126*a*, 126*b* (see FIGS. 5A-B).

A first coil 410*a* may be disposed between the guide 404 and the first lock 406*a*. A second coil 410*b* may be disposed between the guide 404 and the second lock 406*b*. The coils 410*a*, 410*b* may be coupled to the guide 404. Additionally, the first coil 410*a* may be abutted against the guide 404 the first lock 406*a*. Additionally, the second coil 410*b* may be abutted against the guide 404 and the second lock 406*b*.

Figure 5A:
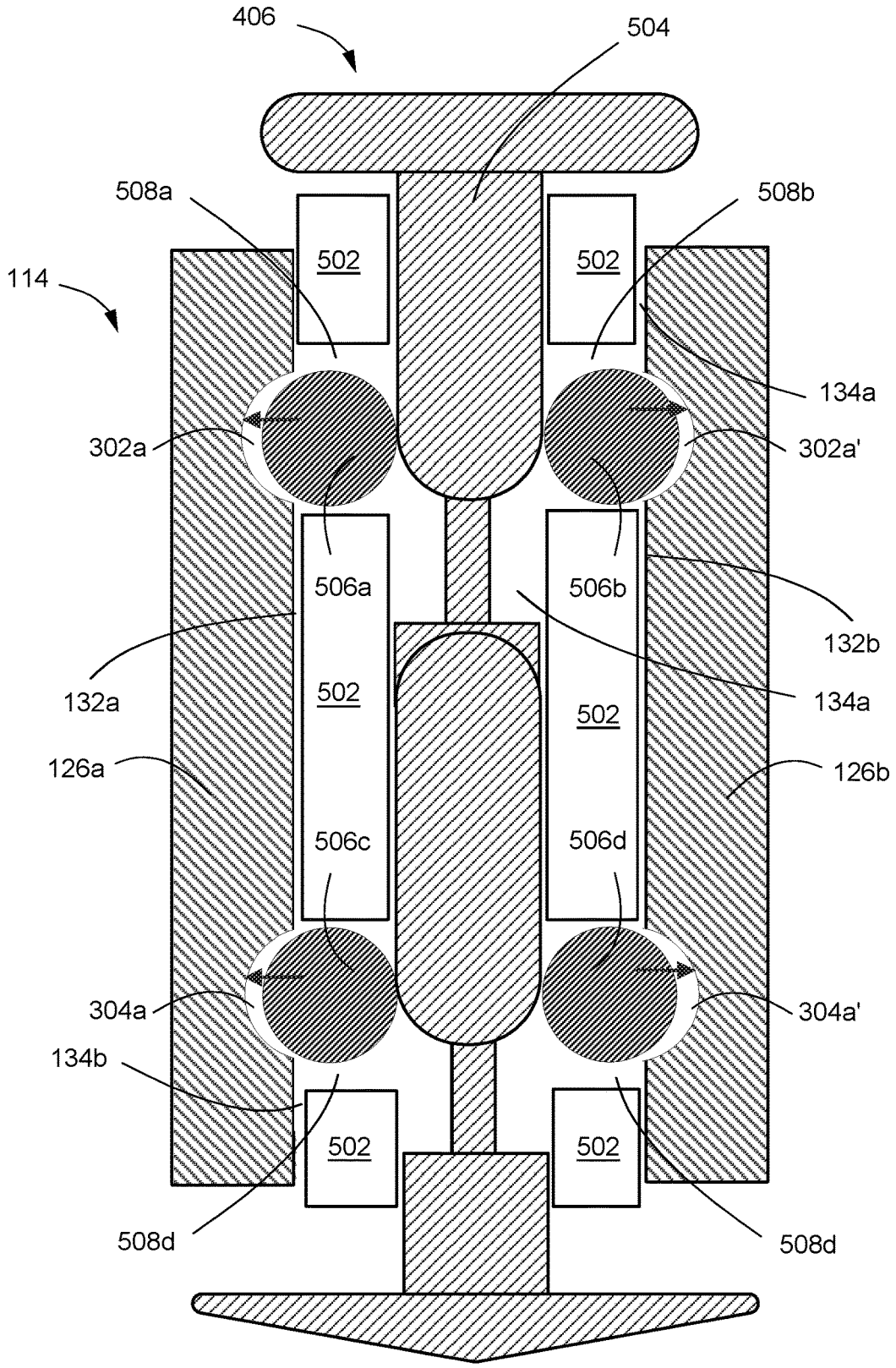
FIG. 5A illustrates a cross-sectional side view of a lock in a locked configuration disposed in a wheel.

FIG. 5A illustrates a cross-sectional side view of a lock 406 in a locked configuration disposed in a wheel 114. The plates 126*a*, 126*b* may define an outer aperture 134*a* and a first inner aperture 134*b*. The aperture 134*a* may be defined by a first surface 132*a* of the first plate 126*a*, a second surface 132*b* of the second plate 126*b*, and an outer spacer 132*a* (see FIG. 3 and FIG. 4). The apertures 134*a*, 134*b* may be defined by a first surface 132*a* of the first plate 126*a*, a second surface 132*b* of the second plate 126*b*, and inner spacers 132*a*, 132*b* (see FIG. 3 and FIG. 4).

Grooves 302*a*, 304*a* may be disposed in the first plate 126*a*. Grooves 302*a*', 304*a*' may be disposed in the second plate 126*b*. The grooves 302*a*, 304*a* may be aligned radially relative to the wheel 114. The grooves 302*a*, 302*a*' may be aligned longitudinally relative to the wheel 114.

The lock 406 may include a housing 502, a plunger 504, and pins 506*a-d*. The housing 502 may include apertures 508*a-d* disposed therethrough. The apertures 508*a-d* may be aligned with grooves 302*a*, 302*a*', 304*a*, 304*a*', respectively. A first portion of the pin 506*a* may be disposed within the groove 302*a*. A first portion of the pin 506*b* may be disposed within the groove 302*a*'. A first portion of the pin 506*c* may be disposed within the groove 304*a*. A first portion of the pin 506*d* may be disposed within the groove 304*a'*.

A second portion of each pin 506 may be disposed in a respective aperture 508 of the housing 502.

The plunger 504 may be abutted against the pins 506*a-d*. Accordingly, the pins 506*a-d* may be abutted against the plates 126*a*, 126*b*, respectively. In the locked position, the lock 406 may be inhibited from movement relative to the wheel 114.

Figure 5B:
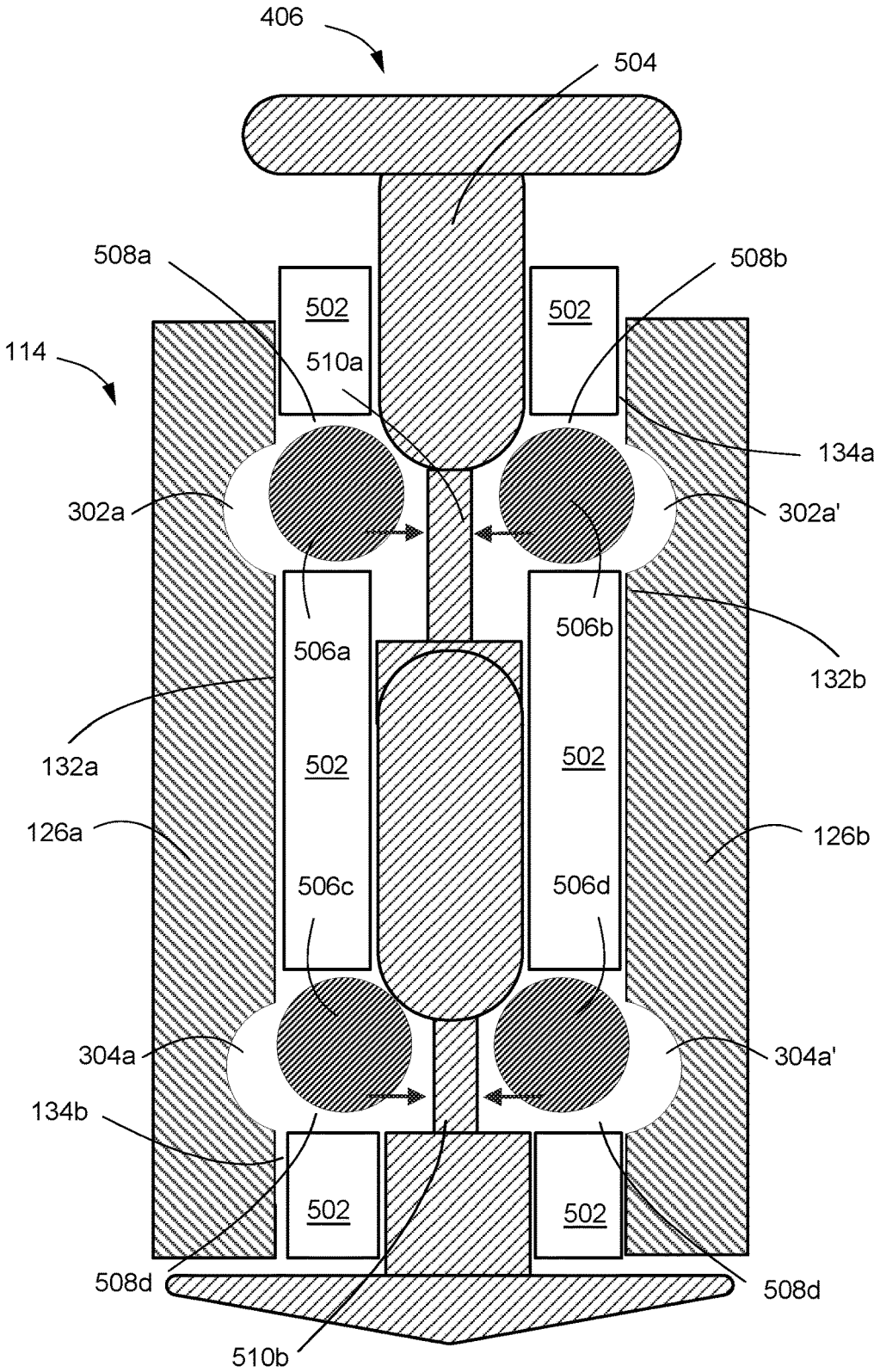
FIG. 5B illustrates a cross-sectional side view of a lock in an unlocked configuration disposed in a wheel.

FIG. 5B illustrates a cross-sectional side view of a lock 406 in an unlocked configuration disposed in a wheel 114. The plates 126*a*, 126*b* may define an outer aperture 134*a* and a first inner aperture 134*b*. The aperture 134*a* may be defined by a first surface 132*a* of the first plate 126*a*, a second surface 132*b* of the second plate 126*b*, and an outer spacer 132*a* (see FIG. 3 and FIG. 4). The apertures 134*a*, 134*b* may be defined by a first surface 132*a* of the first plate 126*a*, a second surface 132*b* of the second plate 126*b*, and inner spacers 132*a*, 132*b* (see FIG. 3 and FIG. 4).

Grooves 302*a*, 304*a* may be disposed in the first plate 126*a*. Grooves 302*a*', 304*a*' may be disposed in the second plate 126*b*. The grooves 302*a*, 304*a* may be aligned radially relative to the wheel 114. The grooves 302*a*, 302*a*' may be aligned longitudinally relative to the wheel 114.

The lock 406 may include a housing 502, a plunger 504, and pins 506*a-d*. The housing 502 may include apertures 508*a-d* disposed therethrough. The apertures 508*a-d* may be aligned with grooves 302*a*, 302*a*', 304*a*, 304*a*', respectively. Each pin 506 may be disposed in a respective aperture 508 of the housing 502.

In addition, the plunger 504 may have stems 510*a*, 510*b*. The plunger 504 may have a first diameter. Each stem 510 may have a second diameter. The second diameter may be smaller than that of first diameter. In the unlocked position, the stem 510*a* may be aligned with the apertures 508*a*, 508*b* of the housing 502 and the grooves 302*a*, 302*a*'. Also, the stem 510*b* may be aligned with the apertures 508*c*, 508*d* of the housing 502 and the grooves 304*a*, 304*a'*.

Thus, in the unlocked position, the pins 506*a-d* may be pushed (via the surfaces 132*a-d* of the respective plates 126*a*, 126*b*) away from the grooves 302*a*, 302*a*', 304*a*, 304*a*'. Moreover, the pins 506*a-d* may be abutted against the stems 510*a*, 510*b*, respectively. In some cases, the pins 506*a-d* may not inhibit movement of the lock 406 relative to the wheel 114. Thus, the lock 406 may be slid along the apertures 134*a*, 134*b* of the wheel 114.

Referring to FIGS. 1-6, a person may use the arm exercise assembly 100 as follow.

First, the person may insert an arm and hand through, e.g., along an x-axis 102, a frame 110 of the arm exercise assembly 100. Next, the person may grasp a handle 130. The person may removably couple the arm exercise assembly 100 to his or her arm with a strap 202. The person may grasp the handle 130 to make a fist.

The person's arm may be in physical contact with electrodes 142, 144 disposed on an upper brace 118 and a lower brace 120, respectively.

Afterwards, the person may configure an arm exercise. First, the person may pull a plunger 504 of a first lock 406*a*. The pulled plunger 504 may have stems 510*a*, 510*b* aligned with apertures 508*a-d* of the housing 502, grooves 302*a*, 302*a*', 304*a*, 304*a*' of the wheel 114, and pins 506*a-d*. Next, the person may move the first lock 406*a* along apertures 134*a*, 134*b* in the wheel 114. The displaced first lock 406*a* may cause the pins 506*a-d* to be abutted against respective plates 126*a*, 126*b*. The plates 126*a*, 126*b* may be abutted against the pins 506*a-d*. Abutting the pins 506*a-d* against the plates 126*a*, 126*b* may cause the pins 506*a-d* to be pushed toward the stems 510*a*, 510*b*, respectively. Thus, in some cases, the pins 506*a-d* may not inhibit movement of the first lock 406*a* relative to the wheel 114.

Afterwards, the person may slide the first lock 406*a* towards grooves 302*b*, 302*b*', 304*b*, 304*b*' in the wheel 114. Next, the person may align the first lock 406*a* with the grooves 302*b*, 302*b*', 304*b*, 304*b*'. The person may then depress the plunger 504. The depressed plunger 504 may have a portion abutted against the pins 506*a-d*. Moreover, depressing the plunger 504 may cause the pins 506*a-d* to be disposed in the groove 302*b*, 302*b*', 304*b*, 304*b*', respectively. Thus, the first locks 406*a* may be coupled to the wheel 114.

While holding the handle 130, the person may pivot his or her first towards the first lock 406*a*. Next, the person may abut a post 136*a* of the handle 130 against the first lock 406*a*. Additionally, the person may about the post 136*a* against a pressure sensor 408*a* coupled to the first lock 406*a*. The person may further press the post 136*a* against the pressure sensor 408*a*. The pressed pressure sensor 408*a* may send a signal to a screen 308*a*. The screen 308*a* may display a value indicating the amount of pressure being applied to the pressure sensor 408*a*.

In addition, while pivoting the handle 130, the person may also cause a guide 404 to push against a coil 410*b*. In turn, the coil may push against a second lock 406*b*. The second lock may be coupled to the wheel 114. Thus, the coil 410*b* may provide resistance against pivoting the handle 130 by the person.

Also, the person may flex his or her wrist while grasping the handle 130 to cause the wheel 114 to pivot away from a piston 140. The piston 140 may be coupled to the wheel 114 via a cable 138. Thus, the piston 140 may provide resistance against pivoting the wheel 114 by the person.

Additionally, the person may removably couple a sleeve 416 around the handle 130 during exercise.

Furthermore, the person may actuate, e.g., press, a switch 146. The actuated switch 146 may complete a circuit between a power supply (not shown) and electrodes 142 disposed on the upper brace 118. The actuated switch 146 may also complete a circuit between the power supply and electrodes 144 disposed on the lower brace 120. Electric current may flow from the power supply through the electrodes 142, 144 to the person's forearm. The electric current may stimulate muscles in the person's arm.

Moreover, the person may actuate, e.g., press, a switch 414 on the handle 130. The actuated switch 414 may complete a circuit between a power supply (not shown) and a motor 412 disposed on the handle 130. Electric current may flow from the power supply to the motor 412. The electric current may cause the motor 412 to vibrate. Vibration from the motor 412 may be transferred to the person's hand that is gripping the handle 130.

To perform a different arm exercise, the person may repeat the steps discussed above with any lock 406 coupled to the wheel 114.

What is claimed as the invention is:

1. An arm exercise assembly, comprising:
- a frame shaped and sized to receive a human forearm;
- a piston coupled to the frame;
- a bracket pivotably coupled to the frame;
- a wheel coupled to the piston and pivotably coupled to the bracket;
- two locks extending radially through the wheel toward inner portions of the wheel; and
- a handle pivotably coupled to the wheel, wherein the handle is capable of being abutted against one or both of the two locks.

2. The arm exercise assembly of claim 1, wherein the frame is cylindrical.

3. The arm exercise assembly of claim 1, wherein the frame has an upper brace having a brace handle.

4. The arm exercise assembly of claim 1, wherein the handle has a portion disposed between the two locks.

5. The arm exercise assembly of claim 1, wherein each of the two locks has a pin extending into a groove of the wheel.

6. The arm exercise assembly of claim 1, wherein each of the two locks has a pin capable of ingress into or egress from a groove of the wheel.

7. The arm exercise assembly of claim 1, wherein the wheel comprises:
- a first groove; and
- a second groove adjacent the first groove, wherein the first groove and the second groove are 12 to 18 degrees apart relative to a central axis of the wheel.

8. The arm exercise assembly of claim 1, wherein the handle has a guide slidably coupled to the wheel.

9. The arm exercise assembly of claim 1, wherein the handle has a guide capable of being abutted against a lock of the two locks.

10. The arm exercise assembly of claim 1, further comprising a pressure sensor coupled to a lock of the two locks.

11. The arm exercise assembly of claim 1, further comprising a sleeve removably coupled to the handle.

12. The arm exercise assembly of claim 1, further comprising a strap coupled to the frame.

13. The arm exercise assembly of claim 1, further comprising an electrode coupled to the frame.

14. The arm exercise assembly of claim 1, further comprising a motor coupled to the handle.

15. An arm exercise assembly, comprising:
- a frame shaped and sized to receive a human forearm;
- a piston coupled to the frame;
- a bracket pivotably coupled to the frame;
- a wheel coupled to the piston and pivotably coupled to the bracket, the wheel having an aperture;
- a first lock disposed in the aperture;
- a second lock disposed in the aperture; and
- a handle pivotably coupled to the wheel, wherein the handle is capable of being abutted against the first lock, the second lock, or both.

16. The arm exercise assembly of claim 15, wherein the handle has a portion disposed between the first lock and the second lock.

17. The arm exercise assembly of claim 15, wherein the wheel further comprises:
- a first coil capable of being abutted against the handle and the first lock; and
- a second coil capable of being abutted against the handle and the second lock.

18. The arm exercise assembly of claim 15, wherein the wheel further comprises:
- a first plate; and a second plate, wherein the first lock and the second lock are disposed between the first plate and the second plate.

19. The arm exercise assembly of claim 15, wherein the wheel further comprises:

a first plate having a first groove; and a second plate having a second groove aligned with the first groove, wherein the first lock and the second lock are disposed between the first groove and the second groove.

20. An arm exercise assembly, comprising:

a frame shaped and sized to receive a human forearm;

a piston coupled to the frame;

a bracket pivotably coupled to the frame;

a wheel coupled to the piston and pivotably coupled to the bracket, the wheel having an aperture;

a first lock slidably coupled to the wheel;

a second lock slidably coupled to the wheel; and a wheel coupled to the piston and pivotably coupled to a handle, the handle comprising:

a first portion capable of being abutted against the first lock; and a second portion capable of being abutted against the second lock.

* * * * *